United States Patent [19]

Schneider

[11] Patent Number: 5,077,708

[45] Date of Patent: Dec. 31, 1991

[54] STOP-WATCH WRISTWATCH

[75] Inventor: Ernest Schneider, Evilard, Switzerland

[73] Assignee: Breitling Montres S.A., Grenchen, Switzerland

[21] Appl. No.: 547,459

[22] Filed: Jul. 3, 1990

[30] Foreign Application Priority Data

Jul. 13, 1989 [CH] Switzerland ..... 2637/89

[51] Int. Cl.[5] ..... G04F 70/0; G04B 19/00

[52] U.S. Cl. ..... 368/107; 368/110; 368/113; 368/281; 368/223; 368/228

[58] Field of Search ..... 368/280, 223, 228, 97–113, 368/224–239

[56] References Cited

U.S. PATENT DOCUMENTS

| | | | |
|---|---|---|---|
| 2,300,950 | 11/1942 | Lux | 368/109 |
| 2,783,835 | 3/1957 | Poole | 368/109 |
| 3,077,729 | 2/1963 | Schlenker | 368/109 |

FOREIGN PATENT DOCUMENTS

| | | |
|---|---|---|
| 2309812 | 9/1973 | Fed. Rep. of Germany . |
| 2823412 | 7/1978 | Fed. Rep. of Germany . |
| 328495 | 4/1958 | Switzerland . |
| 2183373 | 6/1987 | United Kingdom . |

*Primary Examiner*—Bernard Roskoski
*Attorney, Agent, or Firm*—Darby & Darby

[57] ABSTRACT

The minute summer is used as a counting-down device and comprises a rotating disk sector (11) revealing a contrasted dial sector preceding the zero of the graduated scale, at the start of counting-down, and equipped with cut-out (15). This cut-out reveals a second sector (14) of contrasted appearance at the moment when the front edge (19) of the first sector reaches a graduation mark close to zero, for example the final minute, so as to inform the wearer that the final minute has started. Particularly intended for yachting.

4 Claims, 2 Drawing Sheets

STOP-WATCH WRISTWATCH

FIELD OF THE INVENTION

The invention relates to a stop-watch wristwatch comprising a stop-watch hand which completes one revolution per minute and a minute counting-down device comprising a graduated dial on which is mounted a rotating disk sector completing a fraction of a revolution per minute, so that, at the start of counting-down, the disk sector reveals a contrasted dial sector preceding the zero of the graduated scale, the width of this sector diminishing as counting-down proceeds.

PRIOR ART

In order to give the start signal for sports competitions and for displaying the time remaining for play in other sports competitions, it is known to use a disk sector which gradually covers over a dial sector of contrasted appearance, for example black or red, this contrasted sector being completely covered over at the end of the period to be counted down.

The Applicant had the idea of mounting such a counting-down device on a stop-watch wristwatch, the rotating sector being mounted in place of the customary minute-counting hand. This stop-watch wristwatch was primarily intended for those persons engaged in yachting, for displaying the countdown preceding the start signal of a regatta. However, bearing in mind the small size of the minute counting-down device, it proved difficult to distinguish, at a glance, whether one or two minutes remain before the start signal, which, for safety reasons, obliges the user generally to observe the stop-watch second hand for two minutes.

The present invention aims to enable the user to know, at a single glance, whether the final minute has started or not, so that he does not need to observe the second hand before the final minute has started. However, the invention is not restricted to particular numerical values.

SUMMARY OF THE INVENTION

The stop-watch wristwatch according to the invention is defined in that the disk sector has a cut-out and in that the dial of the minute counting-down device has a second sector of contrasted appearance located at an angle such that said cut-out reaches this second contrasted sector of the dial at the moment when the front edge of the first sector reaches a graduated mark close to the zero graduated mark.

Thus, when the user sees the second contrasted sector of the dial appear in the cut-out, he knows that the graduated mark which has just been reached by the front edge of the rotating sector has been passed and that the following minute has been started. For example, if the minute counting-down device advances step by step, by steps of one minute, if, when the contrasted sector appears in the cut-out, the graduated mark which has just been passed by the rotating sector corresponds to one minute before zero, the user knows that the final minute has just started.

According to a particular embodiment, the cut-out has an angular width corresponding to a fraction of an hour, for example one minute, and the width of the second contrasted sector of the dial has the same angular width, for example one minute The invention may also be applied equally to a minute counting-down device which advances step by step and to a counting-down device advancing in a continuous manner. In this latter case, it is also possible to reveal gradually in the cut-out, during the final minute, a part of the dial having a particular color.

BRIEF DESCRIPTION OF THE DRAWINGS

By way of example, the appended drawing shows an embodiment of the invention.

DESCRIPTION OF THE PREFERRED EMBODIMENT

Figure 1:
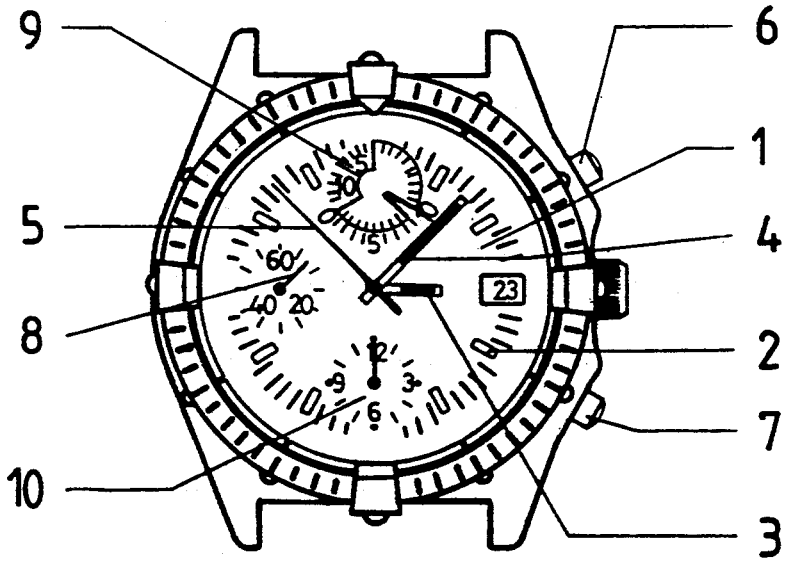
FIG. 1 shows a stop-watch wristwatch equipped with a minute counting-down device according to the invention.

The stop-watch wristwatch shown in FIG. 1 comprises a dial having a main graduated scale 2 for displaying the hour by means of an hour hand 3 and a minute hand 4, it being possible to start and stop a central stop-watch hand 5 by means of a first button 6 and to reset it to zero by means of a second button 7, a small second hand 8, a minute counting-down device 9 and an hour summer 10.

Figure 2:
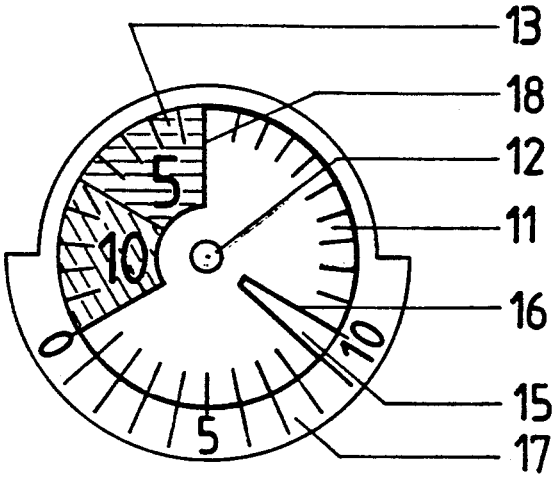
FIGS. 2 to 4 show the minute counting-down device in three successive positions.
Figure 3:
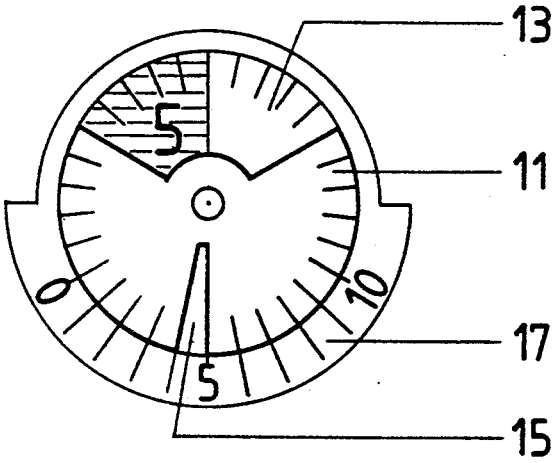
Figure 4:
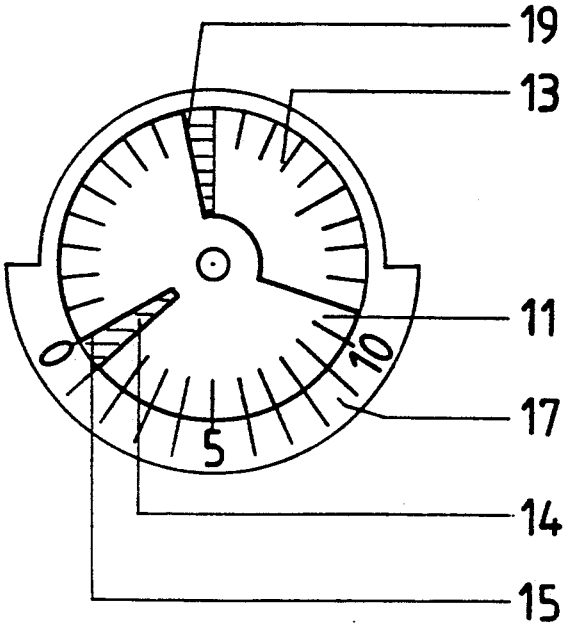

The counting-down device 9 is shown on its own, on a larger scale, in FIGS. 2 to 4. It comprises a disk sector 11 mounted on the spindle 12 in place of the customary minute-counter hand. This sector 11 is graduated and rotates over a dial 13 which is graduated in minutes. The sector 11 completes one revolution in 30 minutes. The part of the dial 13 corresponding to the 25 final five minutes is colored orange and bears the number 5, while the part of the dial 13 located between the final ten minutes and the final five minutes is colored blue and bears the number 10. Before the blue zone, the dial also has a narrow orange sector 14 extending over an angle corresponding to one minute. The rotating sector 11 has a radial cut-out 15 whose width extends over an angle corresponding to one minute. The rear side 16 of the cut-out 15, considered in the direction of rotation of the sector 11, is located on the line bisecting the sector 11. A graduated scale 17, graduated from ten to zero minutes, also extends along the second third of the periphery of the dial 13.

When the stop-watch is at zero, the minute counting-down device occupies the position shown in FIG. 2. In this position, the back edge 18 of the sector 11 is on the zero graduated mark, the orange zone (5 min) and the blue zone (10 min) are entirely visible and the rear edge 16 of the cut-out 15 is opposite the graduated mark 10 of the auxiliary graduated scale 17.

When the signal indicating that ten minutes remain before the start is given, the user presses the button 6 in order to start the stop-watch. With each revolution of the stop-watch hand 5, the sector 11 advances one minute at a time. When the blue zone disappears, the user knows that five minutes remain before the start.

At the end of the ninth minute counted down, the cut-out 15 advances over the orange sector 14. The appearance of the orange color in the cut-out 15 indicates to the user that the final minute has started. From now on, it is necessary only to observe the central stop-watch hand 5.

The cut-out 16 is also used during the counting-down to indicate the time remaining to be counted down by means of the graduated scale 17.

Obviously, the orange sector 14 does not necessarily have to be adjacent to the blue zone, but this sector could be located at a certain distance from this blue zone. The cut-out 15 would then likewise be offset rearwards in the direction of the edge 18.

The counting-down device could also be of the trailing type, that is to say driven by a continuous rotational movement. In this case, the appearance of the orange sector 14 in the cut-out 15 would indicate that the final two minutes have been started. The cut-out 15 would then likewise make it possible to distinguish between two minutes and one minute before the start.

Obviously, the invention may also be applied to any other numerical value, be this the number of revolutions of the sector 11 in one hour, the angle of the sector 11, the number of sectors of the dial in different colors, etc.

It would also be possible to equip the sector 11 with a second cut-out, similar to the cut-out 15, interacting with a sector of the dial 13 in a particular color in order to indicate, for example, that two minutes remain or another specific period of time remains.

I claim:

1. A stop-watch wristwatch comprising a stop-watch hand (5) which completes one revolution per minute and a minute counting-down device (9) comprising a graduated dial (13) on which is mounted a rotating disk sector (11) completing a fraction of a revolution per minute, so that, at the start of counting-down, the disk sector reveals a contrasted dial sector preceding the zero of the graduated scale, the width of this sector diminishing as counting-down proceeds, wherein the disk sector (11) has a cut-out (15) and wherein the dial (13) of the minute counting-down device has a second sector (14) of contrasted appearance located at an angle such that said cut-out reaches this second contrasted sector of the dial at the moment when the front edge (19) of the first sector reaches a graduated mark close to the zero graduated mark.

2. The stop-watch wristwatch as claimed in claim 1, whose minute counting-down device advances in steps of one minute, wherein the second contrasted sector (14) of the dial appears in the cut-out at the moment when the final minute or fraction of a minute has started.

3. The stop-watch wristwatch as claimed in claim 2, in which the rotating sector of the minute counting-down device completes one revolution in thirty minutes, wherein the first contrasted sector of the dial (13) extends over ten minutes and wherein it is divided into two sectors of five minutes with different appearances, wherein the rear edge (16) of the said cut-out is located on the line bisecting the rotating sector and wherein the second contrasted sector of the dial is adjacent to the first contrasted sector and wherein it has the same appearance as the part of the first sector extending over the final five minutes.

4. The stop-watch wristwatch as claimed in claim 1, wherein the dial of the minute counting-down device has a second graduated scale (17) located outside the surface swept by the rotating sector and interacting with the cut-out (15) in order to provide an auxiliary display of the minutes counted down.

* * * * *